US006431426B1

(12) United States Patent
Ehmig

(10) Patent No.: US 6,431,426 B1
(45) Date of Patent: Aug. 13, 2002

(54) HOLDER FOR A DRIVE PISTON OF A SETTING TOOL

(75) Inventor: Gerhard Ehmig, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/071,695

(22) Filed: Feb. 8, 2002

(30) Foreign Application Priority Data

Feb. 9, 2001 (DE) ..... 101 05 881

(51) Int. Cl.[7] ..... B25C 1/04
(52) U.S. Cl. ..... 227/10; 173/211
(58) Field of Search ..... 227/9, 10, 11, 227/130; 173/210, 211

(56) References Cited

U.S. PATENT DOCUMENTS 3,338,141 A * 8/1967 Ramsay ..... 227/10
4,134,527 A * 1/1979 Termet ..... 227/10
4,162,033 A 7/1979 Pomeroy
4,625,442 A * 12/1986 Hill et al. ..... 227/10
5,617,925 A * 4/1997 Boothby et al. ..... 173/211
6,092,710 A * 7/2000 Kersten ..... 173/211
6,123,242 A * 9/2000 Kristen ..... 227/10
6,123,243 A * 9/2000 Pfister et al. ..... 227/10

* cited by examiner

*Primary Examiner*—Scott A. Smith
(74) *Attorney, Agent, or Firm*—Sidley Austin Brown & Wood, LLP

(57) ABSTRACT

A piston holder for a drive piston (8) of a setting tool and including a braking element self-lockingly supportable on a drive piston body (10), and spring elements (21, 23; 27, 28) for applying different biasing forces to the braking element (17; 24–26) in respective opposite directions corresponding to a direction of displacement of the drive piston (8) for reducing self-locking forces with which the braking element (17; 24–26) is supported on the drive piston body (10).

7 Claims, 2 Drawing Sheets

HOLDER FOR A DRIVE PISTON OF A SETTING TOOL

BACKGROUND OF THE INVENTION

1. Field of the Invention

The present invention relates to a holder for a drive piston of a setting tool.

2. Description of the Prior Art

European Publication EP-O 346275 B1 discloses an explosive powder charge-operated setting tool including a piston guide and a drive piston displaceable in the piston guide. The piston guide has radial openings facing the drive piston, and spring-biased braking balls extending through the opening and engaging the drive piston. The spring, which applies a biasing force to the braking balls is formed as a ring spring for applying a radially acting, with respect to the piston, biasing force to the braking balls. The ring spring is provided on its inner profile with a bearing surface acting on the braking ball. The bearing surface is inclined to the piston at an acute angle that opens in a direction opposite a setting direction. When the drive piston moves in the setting direction, it entrains the braking balls therewith. The braking balls expand the ring spring, which results in the bearing surface transmitting the radial biasing force to the braking balls. The braking balls are pressed radially against the piston body by the ring spring washer. Even with a small displacement of the drive piston in a direction opposite the setting direction, the braking effect can be substantially reduced or eliminated, as the braking balls displace in the same direction as the drive piston, unloading the ring spring. After being unloaded, the ring spring does not press any more the braking balls against the piston body. Further, a possibility still remains that the drive piston would be displaced, before ignition or firing of the setting tool, in the setting direction as a result of, e.g., the setting tool being pressed hard against a constructional component. The displacement in the return direction is effected due to cooperation of the ring spring with the braking balls.

U.S. Pat. No. 4,162,033 discloses a setting tool with a braking element that continuously applies a braking force to the drive piston.

An object of the present invention is to provide a piston holder having a simplified design and which would reliably retain the drive piston in its ignition-ready position in the absence of ignition.

SUMMARY OF THE INVENTION

This and other objects of the present invention, which will become apparent hereinafter, are achieved by providing a piston bolder for the drive piston of a setting tool and including braking means self-lockingly supportable on a drive piston body; and spring means for applying different biasing forces to the braking means in respective opposite directions corresponding to a direction of displacement of the drive piston for reducing self-locking forces with which the braking means is supported on the drive piston body. The biasing forces, which are applied to the drive piston body, only slightly increase when the drive piston is displaced in the setting direction, i.e., toward the mouth of the setting tool for driving in, e.g., a fastening element. The setting process is effected under a relatively large braking force applied by the braking means. Therefore, the drive piston-displacing force should be large enough to overcome the braking force. During the return movement of the drive piston into its ignition-ready position, the self-locking force, with which the braking means is supported on the piston body, should be substantially reduced to insure that the drive piston always reaches its ignition-ready position. Nonetheless, during the return movement of the drive piston, the self-locking force is not eliminated completely, as the drive piston, after reaching its ignition-ready position, should be retained therein by the braking means to prevent the drive piston displacement from its ignition-ready position in the absence of the ignition.

According to an advantageous embodiment of the present invention the braking means is formed as a washer having a central opening for receiving the drive piston body and arranged between two, spaced from each other, axial stops fixed relative to the setting tool. The spring means includes two springs having different spring rates, respectively, and acting, respectively, on opposite circumferential sections and on opposite sides of the washer. The two springs can be formed as helical compression springs or as rubber springs. The washer can be formed as a hardened steel washer. According to the present invention, the washer is eccentrically loaded by the two springs in each operational position of the piston holder in such a way that it is self-locked on the piston body. The functioning of the piston holder is substantially the same in both directions of movement of the drive piston, i.e., when it moves in the setting direction and when it moves back to its ignition ready position. During its movement in the setting direction, the drive piston entrains the washer therewith until the washer hits the stop. At this moment, the self-locking of the washer on the piston body ends. In this position of the washer, only one spring acts on the washer for tilting the same. The biasing force of this spring determines the friction force between the washer and the piston body. Due to the different spring rates of the two springs, different braking forces are applied to the drive piston during movement of the drive piston in the different directions. The braking force, which is applied to the drive piston during its displacement in the setting direction, can be very high. However, the braking force, which is applied to the drive piston during its displacement to its initial, ignition-ready position should be small, but not zero. This is because, on one hand, the drive piston should be able to easily return to its ignition-ready position and, on the other hand, be retained in its ignition-ready position.

According to another advantageous embodiment of the present invention, the braking means includes two, spaced from each other, flanges supported on the drive piston shaft and arranged between two, spaced from each other axial stops fixed relative to the setting tool, and a drag hose expandable in an axial direction of the drive piston body and connected to the two flanges. The spring means includes a first compression spring arranged between one side of one of the flanges and a facing the one side, side of another of the flanges, and a second compression spring arranged between the one side of the one of the flanges and a stop facing the one side of the one of the flanges.

The drag hose is a hose the diameter of which is decreased upon application of a tensioning force thereto, and the diameter of which increases upon application of a compression force thereto. Such a drag hose can be, formed, e.g., of wire coils and cross-weaved. When such a hose surrounds the piston body, it becomes self-locked upon application of a tensioning force thereto. When compressed, the hose releases the piston body to a lesser and greater degree. At its opposite ends, the hose is connected with the two flanges. The weaker, first compression spring is, as discussed above, arranged between the two flanges and provides a minimal friction force. During the displacement of the drive piston in the drive-out or setting direction, the drive piston entrains the drag hose therewith until the front, in the setting direction flange, abuts a stationary with respect to the setting tool, stop. This causes compression of the drag hose, and its self-locking on the piston body is released. The drive piston, during its subsequent movement in the setting direction, simply slides through the hose. The friction force between the piston body and the drag hose is determined by the sum of the biasing forces of the first and second springs. The spring rate of the second spring is greater than that of the first spring. Therefore, the friction force, before release of the self-locking of the hose, during the drive piston movement in the setting direction, is relatively large. Analogous action takes place during the return movement of the drive piston. However, in this case, the hose is extended only by the force generated by the smaller spring. Therefore, the friction between the hose and the drive piston body is small. However, the friction force should be greater than zero as a friction or clamping force should be applied to the drive piston in its ignition-ready position.

Both embodiments of the piston holder according to the invention provide for obtaining of a relatively large holding force. This force insures retaining the drive piston in its ignition-ready position, e.g., in the gas-operated tools, until the combustion is completed.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
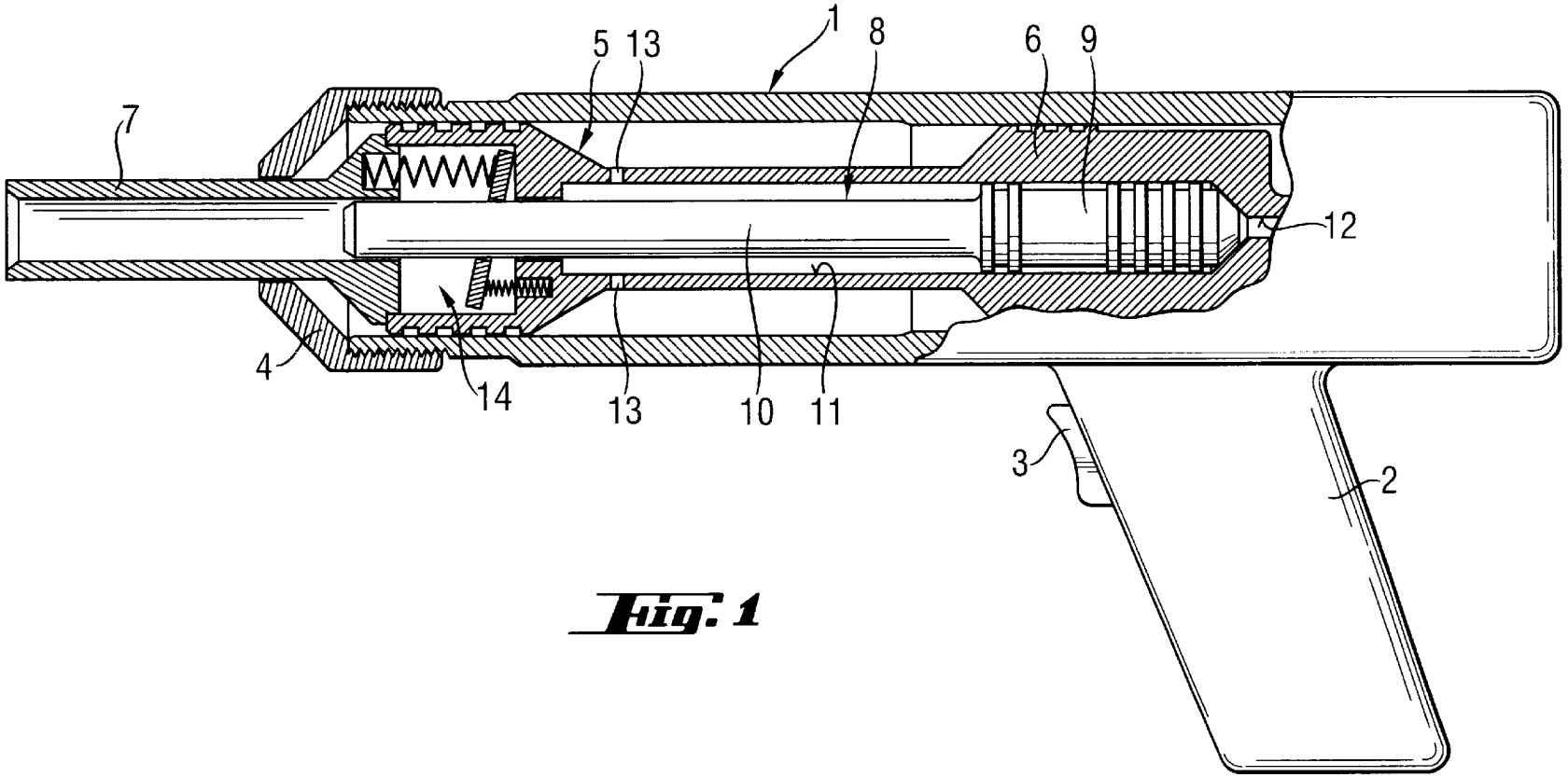
FIG. 1 a partially cross-sectional side view of a setting tool that can be equipped with a piston holder according to the present invention.

A piston bolder according to the present invention can be used with a setting tool a partially cross-sectional view of which a shown in FIG. 1. The setting tool, which is shown in FIG. 1, is an explosive power charge-operated tool. However, the inventive piston holder can also be used in a setting tool driven upon ignition of an air-fuel mixture.

The setting tool, which is shown in FIG. 1, has a housing 1 with a handle 2 and a trigger 3 which, in the embodiment shown in FIG. 1, is provided in the handle. A stop socket 4 is screwed to the housing 1 at the housing end facing in the setting direction of the setting tool. A two-part piston guide 5 is displaceably arranged in the housing 1. The piston guide 5 is formed of rear and front parts 6 and 7, respectively. A drive piston 8 is arranged in the piston guide 5. The drive piston 8 has its head 9 displaceable in the rear part 6 and its body 10 displaceable in the front part 7. An inflow channel 12 for explosion gas of an explosive power charge opens into guide bore 11 of the part 6 at the rear end of the bore 11. At its front end, the part 6 has breakthroughs 13 for releasing air, which is accumulated in front of the piston head 9 of the piston 8 in the piston drive-out or setting direction. The front end region of the rear part 6 concentrically overlaps the rear region of the front part 7. The front part 7 extends beyond the stop socket 4 in the setting direction and forms a delivery tube. The rear end of the front part 7 can extend in form of a tubular projection into the guide bore 11, forming a stop limiting the travel of the drive piston 8.

The piston holder according to present invention can be located in a receiving region 14.

The first embodiment of a piston holder according to the present invention will now be described in detail with reference to FIGS. 2–3.

The piston body 10 of the drive piston 8 is displaceable in a guide channel 15 formed in the front part 7. In the rear and surface of the front part 7, there is provided a cylindrical cavity 16 which is concentric with the guide channel 15. The cylindrical cavity 16 is permanently closed with a component 7*a* provided with a guide channel 15*a*. The piston body 10 is also displaceable in the guide channel 15*a*. The component 7*a* can be releasably connected with the front part 7.

A hardened steel washer 17, which has a central opening 18 through which the piston body 10 also extends, is provided in the cylindrical cavity 16. The steel washer 17 seats on the piston body 10 and extends up to the circumferential wall of the cylindrical cavity 16. The central opening 18 of the steel washer 17 has an inner diameter which is slightly greater than the diameter of the piston body 10 so that the steel washer 17 can tilt relative to the piston body 10. The tilting of the steel washer 17 relative to the longitudinal axis 19 of the piston body 10 generates spring or biasing forces acting in the axial direction. To this end, the steel washer 17 is biased at its opposite circumferential sections from different sides by springs having different spring rates.

Figure 2:
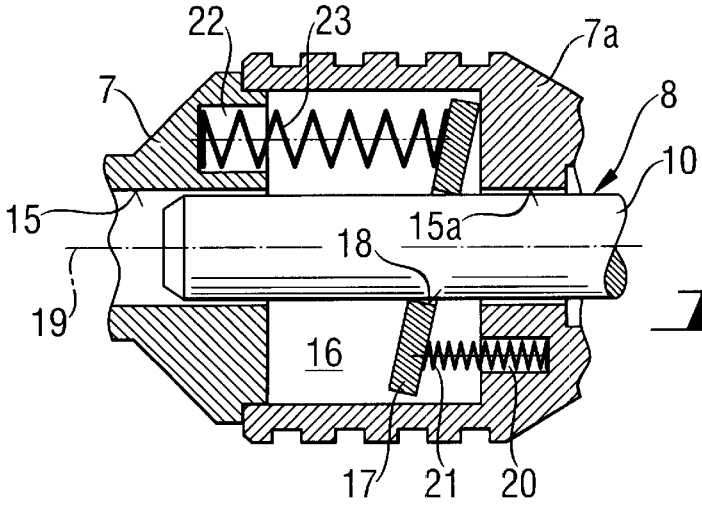
FIG. 2 a cross-sectional view showing the first embodiment of a piston holder according to the present invention in the initial, ignition-ready position of the drive piston.
Figure 3:
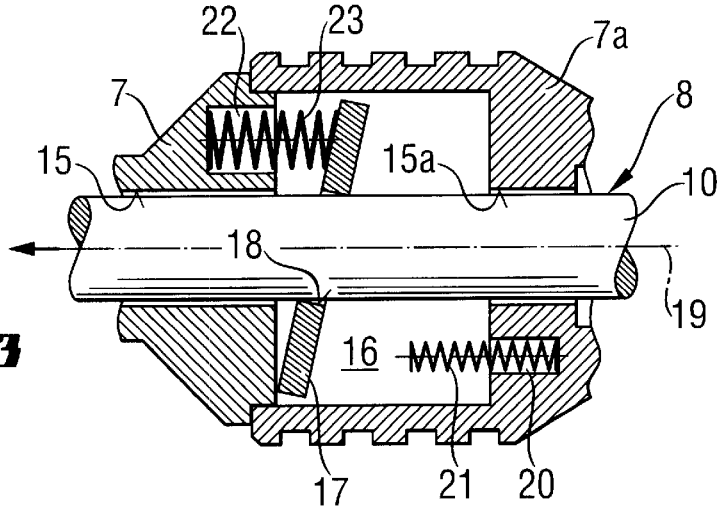
FIG. 3 a cross-sectional view of the piston holder shown in FIG. 2 in the position of the drive piston after firing of the setting tool.

As shown in FIGS. 2–3, in the rear end wall of the cylindrical cavity 16, there is provided a first recess 20 for receiving a first compression spring 21. In the front end wall of the cylindrical cavity 16, there is provided a second recess 22 which is offset with respect to the first recess 20 by 180° in the circumferential direction and which serves for receiving the second compression spring 23. The first and second compression springs 21 and 23 can be formed as, e.g., helical compression springs, rubber springs, etc. The first spring 21 is weaker than the second spring 23 so that the biasing force applied by the first spring 21 is weaker than the biasing force applied by the second spring 23.

FIG. 2 shows the condition of the setting tool in the ignition-ready position of the drive piston 8. The steel washer 17 is slightly biased by the first spring 21 toward the month of the setting tool, i.e., in the setting direction, and is biased more strongly in the opposite direction, against the rear end wall of the cavity 16, by the second spring 23. As a result of different biasing forces acting on it, the steel washer is tilted relative to the longitudinal axis 19 of the drive piston 8. The tilting of the steel washer 17 results in its self-locking on the piston body 10. Thus, the inner circumference of the central opening 18 of the steel washer 17 is pressed against the circumferential surface of the piston body 10. Therefore, the piston body 10 cannot not displace in the position of the steel washer 17 shown in FIG. 2. As long as no ignition takes place, the drive piston 8 is reliably retained in its ignition ready position.

FIG. 3 shows the condition of the setting tool after the ignition. From the condition in FIG. 2, after the ignition, the piston body 10 is displaced in the setting direction, i.e., leftwardly in FIGS. 2 and 3. As a result, the first spring 21 is released, and the second spring 23 becomes compressed. This results in even more strong tilting of the steel washer 17 on the piston body 10 and to even stronger self-locking of the steel washer 17 on the piston body 10. As the piston body 10 advances, the second spring 23 becomes even more compressed until the steel washer 17 impacts the front end wall of the cylindrical cavity 16. With this, the self-locking of the steel washer 17 on the piston body ends. In this position of the steel washer 17, the biasing force of the second spring 23 corresponds to the friction force applied to the piston body 10. This friction or braking force can be made very high in the drive-out direction of the drive piston. This makes possible, e.g., in gas-powered tools, to hold the drive piston in its ignition-ready position until the combustion is completed.

After the completion of the setting process, the drive piston 8, together with the piston body 10, moves back i.e., rightwardly, in FIGS. 2–3. Already after a short displacement backwards, a condition, which corresponds to that of FIG. 2, is reached, i.e., a condition in which the steel washer 17 is supported against the rear end wall of the cylindrical cavity 16. Because of the weak action of the first spring 21, the friction force acting between the steel washer 17 and the piston body 10 becomes small, and the drive position moves back to its ignition-ready position meeting small, if any, resistance.

A second embodiment of a piston holder according to the present invention will be discussed with reference to FIG. 4 in which the elements common with those shown in FIGS. 2–3 are designated with the same reference numerals and will not be further discussed.

According to the second embodiment, a first flange 24 and a second flange 25 are provided in the cylindrical cavity 16 in a spaced relationship to each other. The first and second flanges 24 and 25 are displaceably supported on the piston body 10 of the drive piston 8. Further, between the first and second flanges 24 and 25, on the piston body 10, there is provided a drag hose 26. The opposite ends of the drag hose 26 are fixedly connected with the first and second flanges 24, 25, respectively. A first helical compression spring 27, which is provided between the first and second flanges 24 and 25, biases the first and second flagons 24, 25 away from each other. A second helical compression spring 28 is provided between the second flange 25 and the front end surface of the cylindrical cavity 16. The second spring 28 has a greater biasing force than the first spring 27.

The drag hose 26 is a hose the inner diameter of which is reduced upon application thereto axial tensioning forces, and is increased upon application thereto compressing forces. The drag hose 26 can also be formed as a cross-weaved wire mesh or the like.

Figure 4:
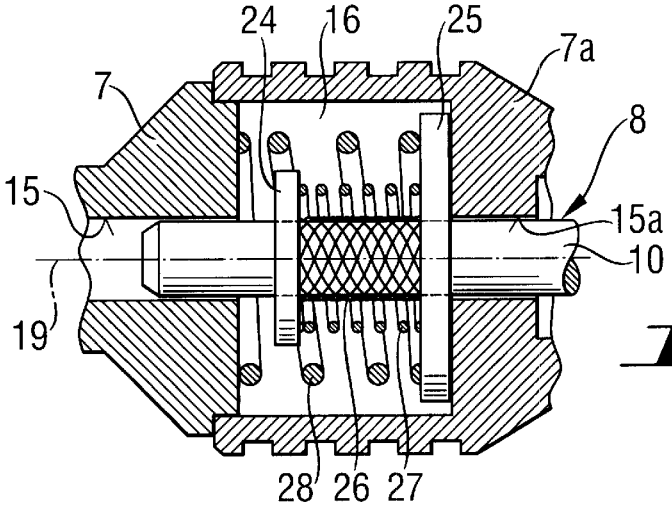
FIG. 4 a cross-sectional view of a second embodiment of a piston holder according to the present invention.

In the position of the braking device 24–28 shown in FIG. 4, the drive piston 8 is in its ignition-ready position. In the absence of ignition, the drive piston 8 or the drive piston body 10 cannot be displaced from the ignition-ready position, as the braking device prevents any displacement. The first, weaker spring 27 biases the first flange 24 away from the second flange 25, tensioning the drag hose 26, and the drag hose 26 applies a small friction force to the piston body 10 which is sufficient to retain the drive piston 8 in its ignition-ready position. The second, stronger spring 28 fixes the second flange 25 in its position.

Upon ignition of firing of the setting tool, the braking device 24–28 is displaced in the setting direction due to the action of the friction forces between the drag hose 26 and the piston body 109. The friction-force between the drag hose 26 and the piston body 10 is determined by the sum of biasing forces of the first, smaller spring 27 and the second, larger spring 28. This friction force can be made very large. The drag hose 26 is carried y the piston body 10 until the first flange 24 abuts the front end surface of the cavity 16. When the first flange 24 abuts the front end surface of the cavity 16, the drag hose 26 is compressed, and the self-locking is released. The drag hose 26 slides abut the piston body 10, and the piston body 10 can be completely drived out. The same takes place upon return movement of the drive piston 8. However, in this case, the drag hose 26 is extended by the force of only the first, smaller spring 27. As a result, during the return movement of the drive piston 8, the friction force between the drag hose 26 and the piston body 10 is correspondingly smaller.

Though the present invention was shown and described with references to the preferred embodiments, such are merely illustrative of the present invention and are not to be construed as a limitation thereof, and various modifications of the present invention will be apparent to those skilled in the art. It is, therefore not, intended that the present invention be limited to the disclosed embodiments or details thereof, and the present invention includes all variations and/or alternatives embodiments within the spirit and scope of the present invention as defined by the appended claims.

What is claimed is:

1. A holder for a drive piston (8) of a setting tool and displaceable in opposite directions, the piston bolder comprising braking means (17; 24–26) self-lockingly supportable on a drive piston body (10); and spring means (21, 23; 37, 28) for applying different biasing forces to the braking means (17; 24–26) in respective opposite directions corresponding to a direction of displacement of the drive piston (8) for reducing self-locking forces with which the braking means (17; 24–26) is supported on the drive piston body (10).

2. A piston holder according to claim 1, wherein the braking means (17) comprises a washer having a central opening (18) for receiving the drive piston body (10) and arranged between two, spaced from each other, axial stops **(7, 7*a*) fixed relative to the setting tool, and wherein the spring means comprises two springs (21, 23)** having different spring rates, respectively, and acting, respectively, on opposite circumferential sections and on opposite sides of the washer.

3. A piston holder according to claim 2, wherein the two springs (21, 23) are formed as helical compression springs.

4. A piston holder according to claim 2, wherein the two springs (21, 23) are formed as rubber springs.

5. A piston holder according to claim 1, wherein the braking means (24–26) comprises two, spaced from each other, flanges (24, 25) supported on the drive piston shaft (10) and arranged between two, spaced from each other axial stops **(7, 7*a*) fixed relative to the setting tool, and a drag hose (26) expandable in an axial direction (19) of the drive piston body (10) and connected to the two flanges (24, 25); and wherein the spring means (27, 28) comprises a first compression spring (27) arranged between one side of one of the flanges (25) and facing the one side of the one of the flanges, a side of another of the flanges (24), and a second compression spring (28) arranged between the one side of the one of the flanges (25) and a stop (7**) facing the one side of the one of the flanges.

6. A piston holder according to claim 5, wherein the drag hose (26) is formed of wire coils.

7. A piston holder according to claim 5, wherein the compression springs (27, 28) are formed as helical compression springs.

* * * * *